US006296524B1

(12) United States Patent
Goto

(10) Patent No.: US 6,296,524 B1
(45) Date of Patent: Oct. 2, 2001

(54) ELECTRICAL CONNECTOR

(75) Inventor: Masayuki Goto, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/707,959

(22) Filed: Nov. 8, 2000

(51) Int. Cl.[7] ..... H01R 24/00
(52) U.S. Cl. ..... 439/660; 439/848
(58) Field of Search ..... 439/74, 660, 848, 439/849, 876, 722, 736, 81

(56) References Cited

U.S. PATENT DOCUMENTS 5,224,866 * 7/1993 Nakamura et al. ..... 439/81
5,639,248 * 6/1997 Yagi ..... 439/74
5,800,186 * 9/1998 Ramirez et al. ..... 439/74
5,885,092 * 3/1999 Ito et al. ..... 439/74
6,036,504 * 3/2000 McHugh et al. ..... 439/74
6,036,549 * 3/2000 Wulff ..... 439/660

* cited by examiner

*Primary Examiner*—Brian Sircus
*Assistant Examiner*—Son V. Nguyen
(74) *Attorney, Agent, or Firm*—Kanesaka & Takeuchi

(57) ABSTRACT

An electrical connector comprises a terminal (12) having a contact section (13) for contact with a mating terminal (22) and a housing (11) made of an insulative material and molded integrally with the terminal. The contact section (13) is indented and a side ridge (14) is raised from the contact section.

4 Claims, 3 Drawing Sheets

ELECTRICAL CONNECTOR

BACKGROUND OF THE INVENTION

1. Field of the Invention

The present invention relates to electrical connectors and, particularly, to an electrical connector made by integrally molding a housing and terminals.

2. Description of the Related Art

Japanese SUM patent application Kokai No. 3-126389 discloses a pair of electrical connectors locked to each other. As FIG. 3 shows, a first connector 50 has a housing 51 to which a terminal 52 is attached. The terminal 52 has a contact section 53 with a trapezoidal recess 54. A second connector 60 has a housing 61 to which a resilient terminal 62 is attached. The resilient terminal 62 has a semi-circular projection 63 at a tip thereof and a small semi-circular contact portion 64 at the middle position thereof.

In use, the second connector 60 is plugged into the first connector 50 in a direction A such that the projection 63 of the terminal 62 is snapped in the recess 54 of the terminal 52, locking contact between the contact portion 64 and the contact section 53. In the above connectors, the terminal 52 is fitted into the housing 51 upon assembling.

It is well known that a terminal can be integrally molded with the housing of an electrical connector. If the electrical connector of FIG. 3 is made by such integral molding, the recess 54 of the terminal 52 is filled with the molding resin, causing poor contact. In addition, the resin can adhere to the contact section 53 with which the contact portion 64 of the mating connector 60 is brought into contact.

Since the position for making electrical contact is different from the position for locking the electrical contact, the terminal becomes long, resulting in the large connector. To avoid such a problem, it is desired that the lock section works also as contact section. However, this is difficult to do because of the above problem that the resin can adhere to the lock section.

SUMMARY OF THE INVENTION

Accordingly, it is an object of the invention to provide an electrical connector capable of allowing integral molding of a housing and a terminal without resin adhesion to the contact section, thus providing reliable contact between the terminals.

An electrical connector relative to the invention comprises a housing made of an insulative material and at least one terminal made of an elongated metal member and molded integrally with the housing such that a contact section thereof is exposed in the housing for contact with a mating terminal.

According to the invention, a side ridge is provided around the contact section so that the metal mold is brought into close contact with the side ridge to prevent the insulative material from entering the contact section. The mating terminal is moved in a direction parallel to or perpendicular to the contact section for contact. Where it is moved in parallel, it produces a click when it passes the side ridge, indicating that the terminal has reached a predetermined position and been locked.

The side edge may have a width greater than that of the elongated metal member to absorb a widthwise positionally error of the mating terminal. This is particularly effective where a plurality of terminals are arranged at small intervals. The contact section may have a width equal to or greater than that of the elongated metal member, producing great advantages. It is preferred that the side edge is flush with a surface portion of the housing surrounding the side edge so that the mating terminal can reach the side edge without resistance.

DESCRIPTION OF THE PREFERRED EMBODIMENTS

An embodiments of the invention will now be described with reference to FIGS. 1 and 2.

Figure 1:
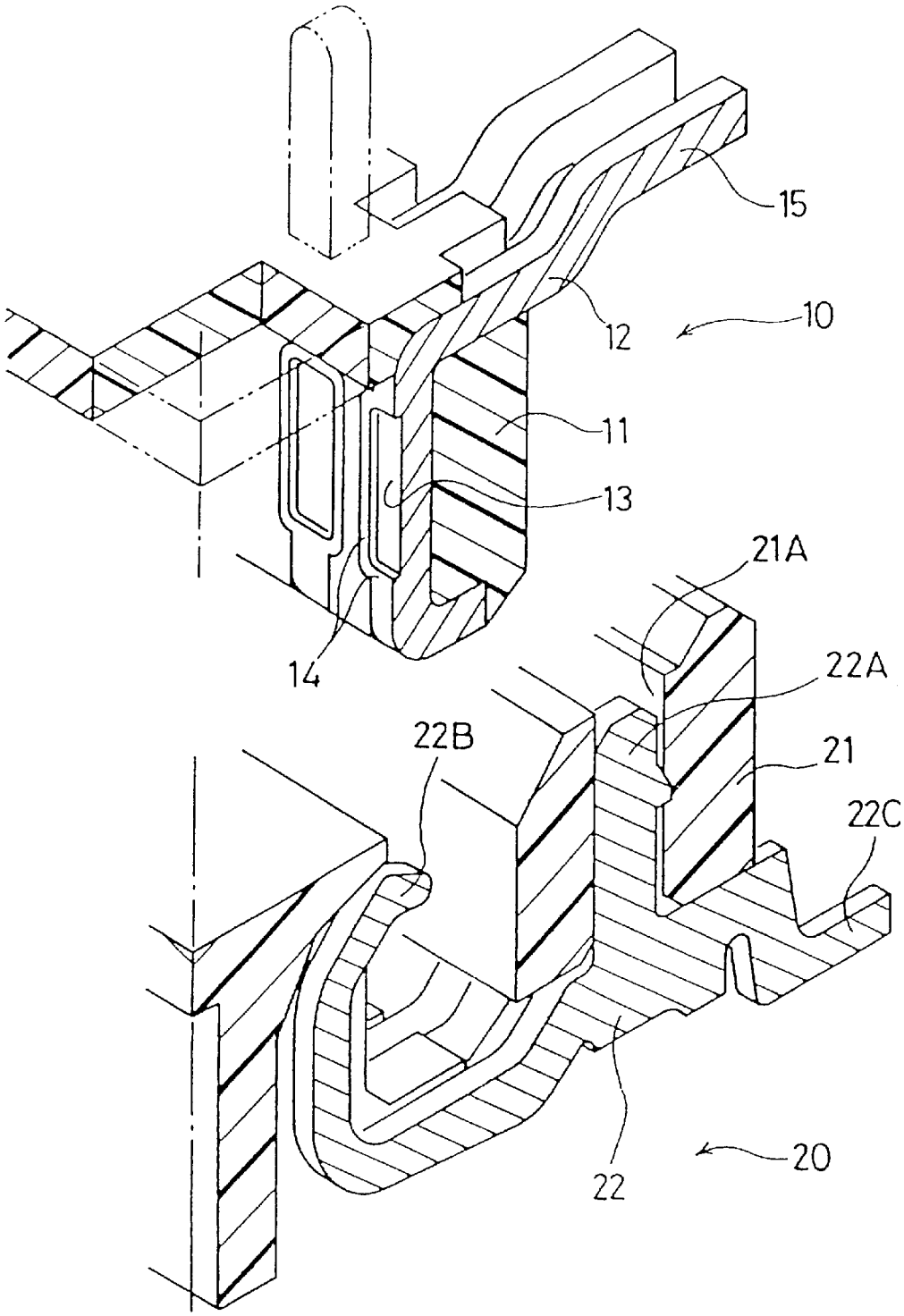
FIG. 1 is a perspective, cross-section of a mating connector and an electrical connector according to an embodiment of the invention.

In FIG. 1, a connector 10 and a mating connector 20 are shown in the right side portion only and the symmetrical left side portion is omitted. The connector 10 is made by integrally molding a housing 11 and terminals 12. Each terminal 12 is made by stamping from a metal sheet a comb-like member which consists of a carrier strip and a plurality of elongated members extending outwardly from the carrier strip and applying some work to the comb-like member. Then, the housing 11 is molded integrally with the comb-like member. Finally, the carrier is cut off or additional bending work is applied to provide such a form as shown in FIG. 1.

The terminal 12 has a contact section 13 exposed within the housing 11 and a connection section 15 projecting from the housing 11. The contact section 13 was a surface of the metal sheet from which the comb-like member is formed. A plurality of such terminals 12 are arranged at very small intervals. Before molding, press work is applied to the comb-like member to form an indented surface or contact section 13 with a side edge 14 surrounding it. Upon integral molding, the surface of a metal mold is brought into close contact with the side edge 14 so that no resin can reach the contact section 13 via the side edge 14.

It is desired that the width of the contact section 13 is sufficiently large to absorb spatial errors between the connectors. The side edges 14 is extended widthwise so that the width of the contact section 13 is equal to or larger than the width of the elongated member prior to being pressed. Consequently, as far as the terminal of a mating connector is within the original width of the elongated member, it is possible that the terminals of both connectors are brought into contact with each other. The side edge 14 is flush with the surface of the housing 11.

The mating connector 20 comprises a housing 21 to be plugged to the housing 11 and a terminal 22 attached to the housing 21. The terminal 22 is made by stamping a metal sheet so as to provide a mount section 22A, a curved contact finger 22B, and connection section 22C. The mount section 22A is press-fitted into a retention groove 21A of the housing 21 to secure the terminal 22 to the housing 21. The contact finger 22B extends in a C-shaped form, providing flexibility and a predetermined pressure on the terminal 12 of the connector 10.

Figure 2:
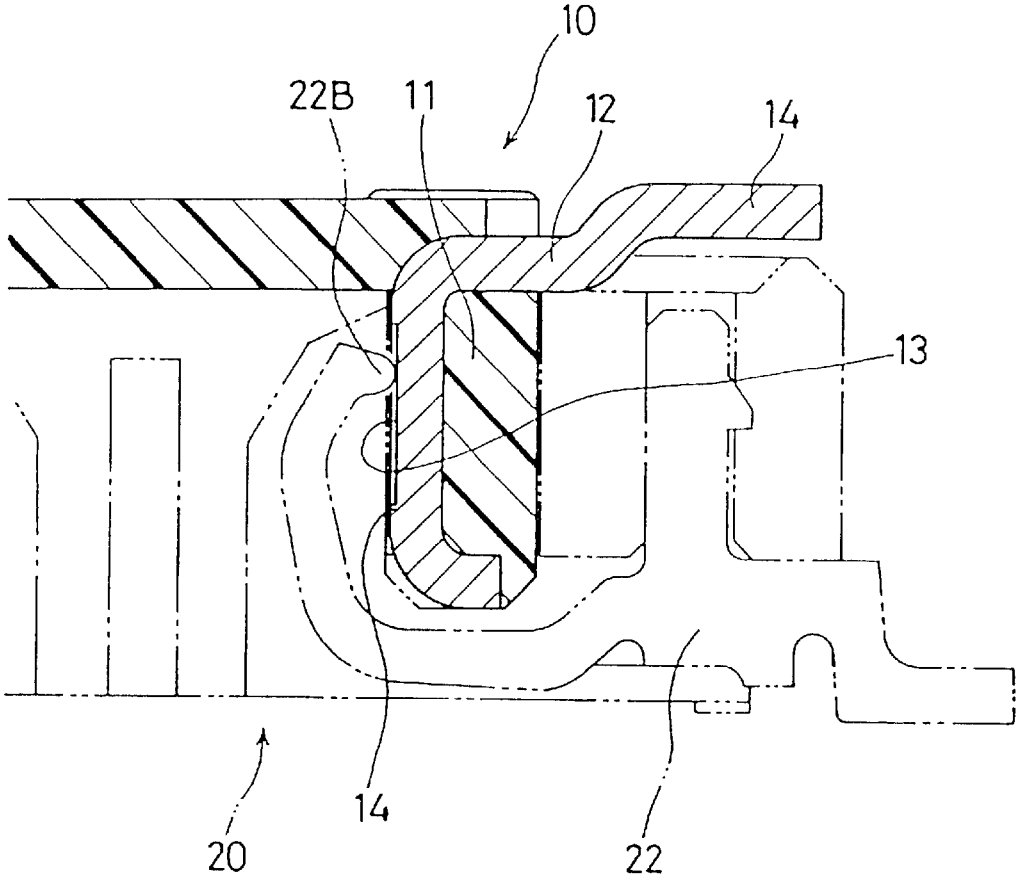
FIG. 2 is a cross-section of the electrical connector plugged into the mating connector.
Figure 3:
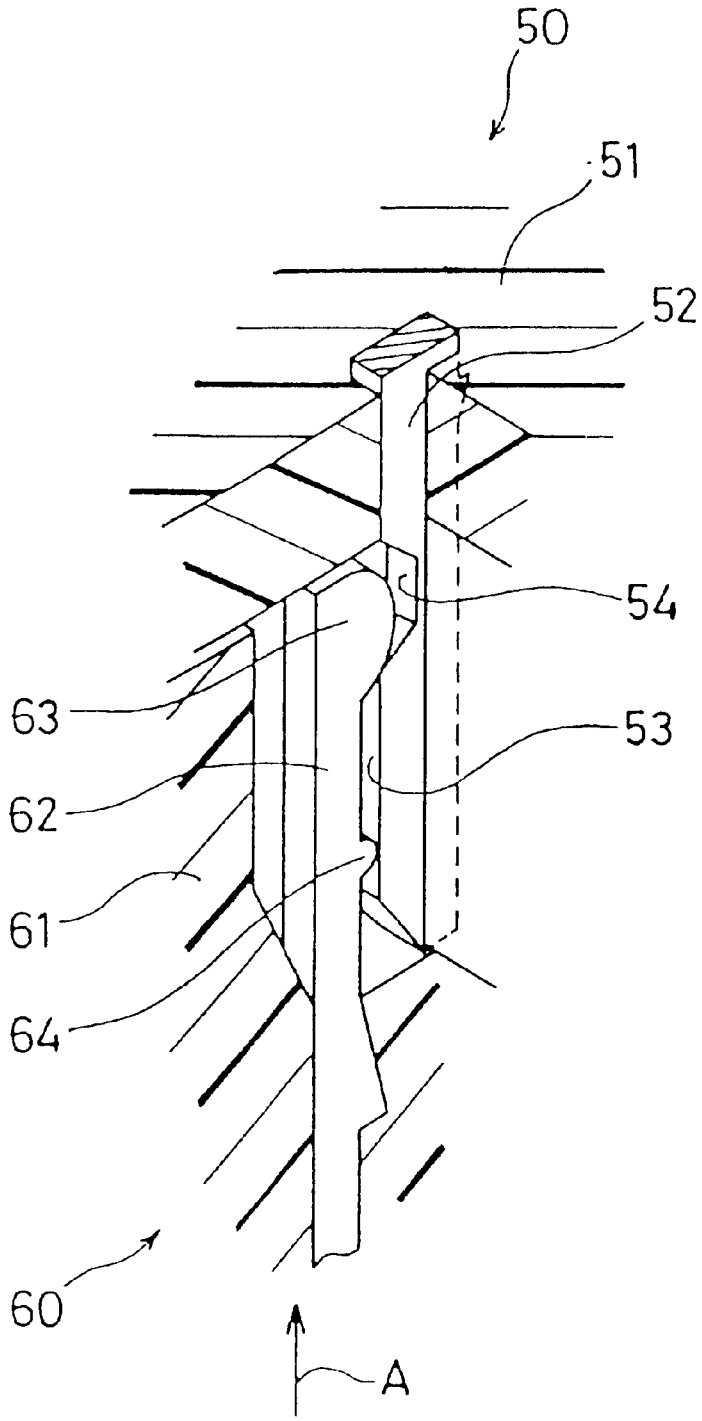
FIG. 3 PRIOR ART
FIG. 3 is a perspective, cross-section of a conventional electrical connector.

These connectors 10 and 20 are plugged to each other as shown in FIG. 2, wherein the mating connector 20 is drawn in phantom line for facilitating easy understanding. The mating connector 20 is plugged upwardly into the connector

10 so that the contact finger 22B reaches the contact section 13 from below. That is, the contact finger 22B first makes resilient contact with the portion below the contact section 13 and, then, slides upwardly to the contact section 13 past the side edge 14, at which a click is produced, not only assuring that the contact finger 22B makes contact with the contact section 13 but also locking these connectors.

The contact section 13 is made wider by press so that some positionally errors of the terminal of a mating connector can be absorbed. In addition, the side edge 14, which is higher than the contact section 13, guides the contact finger 22B into the contact section 13. Since the side edge 14 is flush with the surface of the housing 11 in the above embodiment, the contact finger 22B is readily guided from the housing surface into the contact section 13. However, it is not necessary to be flush with the housing surface for a certain type of connector.

The invention as claimed is not limited to the illustrated embodiment. For example, the width of the contact section may be smaller than the width of the original elongated member but it is preferred that the width is as large as possible. The connection section of a terminal may extend straight upwardly as shown by phantom line in FIG. 1. Where the contact portion or finger of a mating terminal slides on the contact section to a predetermined position, the contact section should have a satisfactory length in the longitudinal direction of the elongated member so that abutment between both the housings indicates that plugging is complete at a predetermined position. In addition, a small difference in the plugging depth of a mating connector can be absorbed. The contact portion and section may be made such that they abut head-to-head each other.

As has been described above, according to the invention, the contact section is indented and the side edge is raised around it so that no resin enters the contact section upon molding of the housing. Plugging of a mating connector produces a click, indicating that firm contact is made. When the side edge is expanded outwardly, the contact section becomes as wide as or wider than the original elongated member, providing a certain tolerance for positionally errors of a mating terminal. Moreover, some errors outside the tolerance can be corrected by the side edge of the contact section.

What is claimed is:

1. An electrical connector comprising:

a housing made of an insulative material;

at least one terminal made of an elongated metal member and having an indented contact section for contact with a mating terminal; and an encircling side edge provided around said indented contact section to prevent said insulative material from adhering to said indented contact section.

2. An electrical connector according to claim 1, wherein said indented contact section has a width greater than a width of said elongated metal member.

3. An electrical connector according to claim 2, wherein said indented contact section has a width equal to or greater than a width of said elongated metal member.

4. An electrical connector according to claim 1, wherein said encircling side edge is flush with a surface portion of said housing.

* * * * *